United States Patent [19]

Lightner, Sr.

[11] Patent Number: 5,063,751

[45] Date of Patent: Nov. 12, 1991

[54] APPARATUS FOR REFRIGERATING DRINKING WATER

[76] Inventor: William G. Lightner, Sr., 7211 SE. 87th Ave., Portland, Oreg. 97266

[21] Appl. No.: 492,751

[22] Filed: Mar. 13, 1990

[51] Int. Cl.[5] ..... F25D 17/02

[52] U.S. Cl. ..... 62/201; 62/399

[58] Field of Search ..... 62/258, 399, 201, 389

[56] References Cited

U.S. PATENT DOCUMENTS

| | | | |
|---|---|---|---|
| 890,912 | 6/1908 | Kurz | 62/258 |
| 2,603,072 | 7/1952 | Berwick | 62/201 |
| 3,926,006 | 12/1975 | Brooks et al. | 62/66 |
| 4,309,875 | 1/1982 | Radichio | 62/66 |
| 4,416,118 | 11/1983 | Brister | 62/66 |
| 4,433,556 | 2/1984 | Brady | 62/293 |
| 4,437,319 | 3/1984 | Iannelli | 62/399 X |

*Primary Examiner*—William E. Wayner
*Attorney, Agent, or Firm*—Henderson & Sturm

[57] ABSTRACT

An apparatus for cooling drinking water in combination with a conventional refrigeration system of a type including a compressor, a condenser and an evaporator. A container having insulated walls and a sealed chamber is provided and has the evaporator therein in the shape of a substantially helically shaped coil. The substantially helically shaped water pipe inserted inside of the helically shaped freon pipe whereby a larger volume of water will be maintained cold by using a helically shaped freon and water pipe than if a straight water pipe were to be used in the cooling chamber. Additionally, because of the small cross section of the water pipe, the cold water will pass out of the cool chamber without mixing in any substantial way with warmer water entering the helical water pipe.

6 Claims, 2 Drawing Sheets

APPARATUS FOR REFRIGERATING DRINKING WATER

TECHNICAL FIELD

The present invention relates to an apparatus for cooling drinking water and more particularly to such a system which eliminates the need for a liquid holding tank.

BACKGROUND ART

In warmer climates where the ground seldom freezes, most water pipes are buried only about six inches beneath the surface of the ground. This causes cold water from a well or other source of water to be warmed extensively by the heat of the sun. Consequently, when this water is piped into a home or commercial establishment for drinking, it is too warm for that purpose.

One way to solve the aforementioned problem is to provide an insulated liquid holding tank similar to a hot water heater but designed to keep the water cold instead of hot and then to provide a refrigeration system and to pipe the water to a drinking valve or the like. A problem with this latter approach is that it is expensive and as the warmer water enters the holding tank, it raises the temperature of the cooler water within such holding tank. This last mentioned device is also expensive to install and to operate, thereby creating a need for a better solution to the problem.

DISCLOSURE OF THE INVENTION

The present invention relates generally to an apparatus for cooling drinking water in combination with a conventional refrigeration system of a type including a compressor, a condenser and an evaporator. A container having insulated walls and a sealed chamber is provided and has the evaporator therein formed in the shape of a substantially helically shaped coil. A substantially helically shaped water pipe is also disposed in said chamber in close proximity to the evaporator whereby a larger volume of water will be maintained cold by using a helically shaped water pipe than if a straight water pipe were to be used in the chamber. Additionally, because of the small cross section of the pipe, the cold water will pass out of the cooling chamber without substantial mixing with the warmer water entering the helical water pipe. The substantially helically shaped water pipe is inserted inside of the helically shaped freon pipe so as to allow equal cooling displacement throughout the entire water pipe.

An object of the present invention is to provide an improved apparatus for refrigerating drinking water.

Another object of the present invention is to refrigerate the helical cold water line of the aforementioned apparatus by cooling the incoming water.

Another object of the present invention is to allow the cold water to exit the cold water pipe without mixing in any substantial way with warmer water entering the cooling chamber of the helical cold water pipe.

A still further object of the present invention is to provide a cooling chamber which keeps the metal pipe of a helical water pipe cold so that when water passes therethrough, it will be chilled, thereby virtually maintaining a constant cold water source as the water flows through the helical cold water pipe.

A still further object of the present invention is to eliminate the need for a water holding tank.

Other objects, advantages, and novel features of the present invention will become apparent from the following detailed description of the invention when considered in conjunction with the accompanying drawings.

BEST MODE FOR CARRYING OUT THE INVENTION

Figure 1:
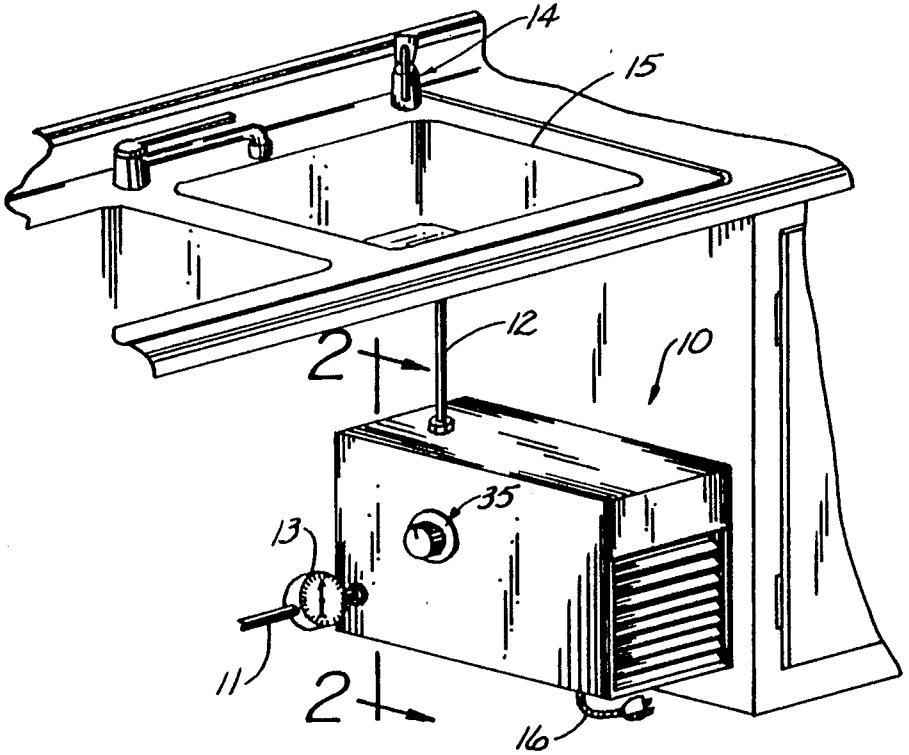
FIG. 1 is a perspective view of a preferred embodiment of the present invention shown disposed beneath a sink in a residential setting for supplying a virtually constant supply of cool water to a drinking valve.

Referring now to the drawings wherein like reference numerals designate identical or corresponding parts throughout the several views, FIG. 1 shows an improved apparatus (10) for refrigerating drinking water attached to a water inlet pipe (11) and a water outlet pipe (12). Water pressure gauge (13) is connected on the inlet line (11). The water outlet (12) is connected to a valve (14) which empties into a sink (15), although the drain for the sink is not shown.

Figure 2:
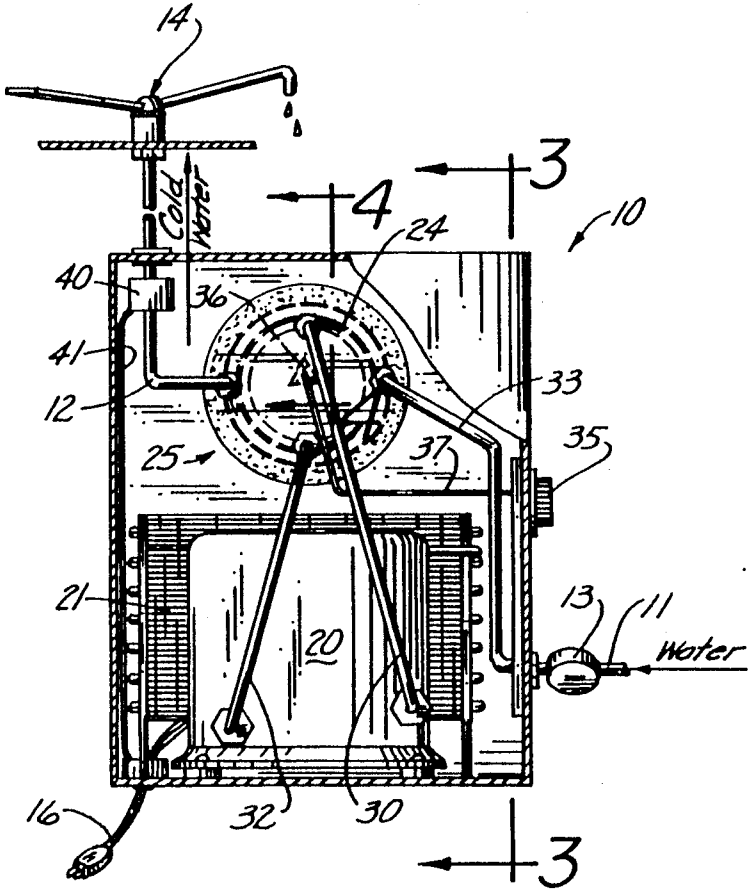
FIG. 2 is a cross sectional view taken along line 2—2 of FIG. 1 and shows a condenser, compressor and the freon piping therebetween, as well as the water pipe passing through and past a cooling chamber where the helically shaped evaporator is positioned.

Referring now to FIG. 2, it is noted that the apparatus (10) includes a basic refrigeration system including a compressor (20), a condenser (21), a cooling motor (22) and fan (23) for passing air over the condenser (21) and an evaporator (24) which is of an unconventional shape although it operates in the manner of a conventional evaporator. Other parts of the refrigeration system are not shown since these are well known to those skilled in this art.

Figure 4:
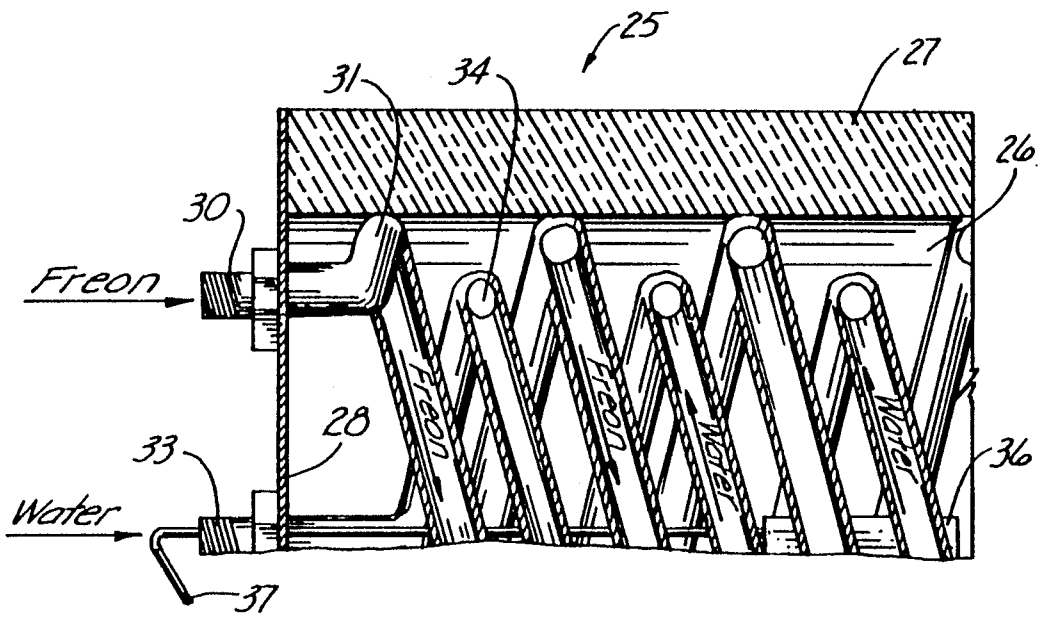
FIG. 4 is an enlarged partial cross sectional view taken along line 4—4 of FIG. 2 and showing the flow of water in the helical water pipe and the flow of freon in the helical evaporator pipe.
Figure 3:
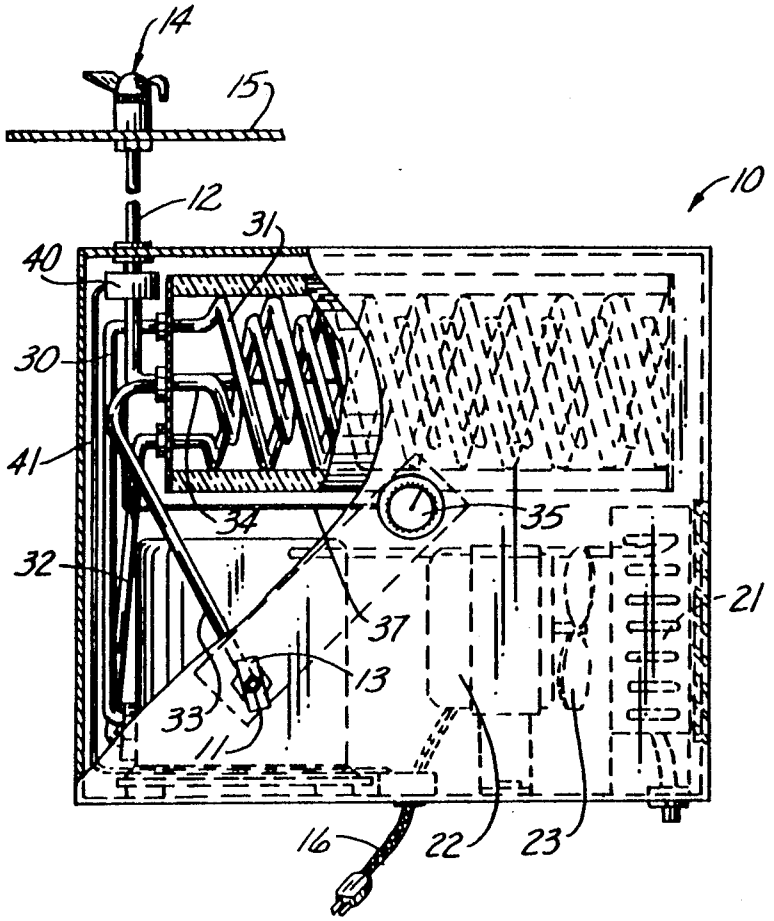
FIG. 3 is a view taken along line 3—3 of FIG. 2 and showing a portion of the insulated container broken away to show a helical water pipe inserted inside of a helical freon or evaporator pipe.

Referring to FIGS. 3 and 4, it is noted that a container (25) has a chamber (26) therein. The container (25) has an insulating material (27) in substantially a cylindrical shape and the ends of the cylinder (27) are sealed on each end thereof by a plate (28) which is shown to be a thin metal plate (28) but which can be insulated to prevent substantial heat exchanges therethrough. Freon enters the inlet pipe (30) and passes into the helical evaporator pipe (31). As the freon evaporates, heat within the chamber (26) will pass into the helical evaporator pipe (31) and into the freon going therethrough. This freon will exit through pipe (32).

At the same time, water will enter the inlet pipe (33) and pass through the helical portion (34) thereof, which is disposed entirely within the chamber (26) and in close proximity to the evaporator coil (31). As the water passes through the metal water pipes (34), heat passes from the water therein to the evaporator coil (31), thereby cooling the water within the water pipe (34). The helically shaped water coil is inserted inside of the helically shaped freon pipe so as to allow equal cooling displacement throughout the entire water pipe.

When the valve (14) is closed, the water within the helical coil (34) will be cooled to a certain desired predetermined temperature as adjusted by the thermostat (35) which includes a sensor portion (36) disposed within the chamber (26). A line (37) leads from the sensor (36) to the thermostat (35). The thermostat (35) would be very similar to the thermostatic control of a common refrigerator in that it can be set to a desired temperature and the refrigeration system will generally maintain that temperature within the chamber (26).

When the valve (14) is opened, the cold water within the water pipe (34) will pass out through the coil (34) through outlet pipe (12). When the valve (14) is opened, the drop in pressure of the water pipe at pressure sensor (40) activates the compressor, starting the cooling process. When the water valve (14) is closed, the pressure at pressure sensor switch (40) increases and de-activates the compressor, thus shutting down the cooling process. The temperature control switch (35) is for the sole purpose of maintaining a constant cool temperature in conjunction with the water pressure switch. Line (41) represents an electrical connection between the pressure sensing switch (40) and the power supply for the compressor. Warm water from pipes (11) and (33) will feed warm water into the inlet end of the helical pipe (34) while cold water is exiting out the pipe (12) and valve (14). This entering warm water will also immediately be cooled because the chamber (26), the metal water pipe (34) and the condenser coil (31) will all be cold. Consequently, under normal circumstances where the valve (14) is used for drinking and is not constantly on, a virtual constant supply of cold water is available because of the stored cold water within the chamber (26) and the fact that water will immediately be cooled upon entering and passing through the water pipe coil (34).

Accordingly, it will be appreciated that the present invention does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. An improved apparatus for cooling drinking water in combination with a conventional refrigeration system including a compressor, a condenser, and an evaporator, the improvement comprising:

a container having insulated walls and a sealed chamber disposed therein;

said evaporator comprising a substantially helically shaped coil disposed in said chamber, said evaporator having an inlet and an outlet;

a substantially helically shaped water pipe disposed in said chamber and inside of said helically shaped evaporator coil so as to allow equal cooling displacement throughout the entire water pipe, said water pipe having an inlet and an outlet;

whereby a longer length of water pipe and therefore a larger volume of water will be maintained cold by using a helically shaped water pipe that if a straight length of water pipe were to be used in said chamber; and, a pressure switch and a thermostat means for sensing the temperature within said container and turning said compressor on or off in response to said temperature or water pressure drop.

2. The apparatus of claim wherein said container is disposed in a cabinet directly under a drinking outlet valve and said improvement includes means for connecting said outlet valve to the outlet of said water pipe.

3. The apparatus of claim 1 wherein said entire refrigeration system is disposed in a cabinet below a sink, an outlet valve is attached to said sink and wherein the improvement further includes means for connecting the outlet of said water pipe to said outlet valve.

4. The apparatus of claim 1 wherein said container is substantially cylindrical in shape and said helically shaped evaporator coil is in close proximity to the interior walls of said container.

5. The apparatus of claim 4 wherein said helical evaporator coil is disposed radially inwardly from said helical water pipe.

6. The apparatus of claim 1 including a pressure switch and a thermostat means for sensing the temperature within said container and turning said compressor on or off in response to said temperature or water pressure drop.

* * * * *